US007789613B1

(12) United States Patent
Weinlader

(10) Patent No.: US 7,789,613 B1
(45) Date of Patent: Sep. 7, 2010

(54) BUCKET LOADER FOR SMALL TRACTORS AND ALL TERRAIN VEHICLES

(76) Inventor: J. Keith Weinlader, 337 Ludwell Dr., Lancaster, PA (US) 17601

( * ) Notice: Subject to any disclaimer, the term of this patent is extended or adjusted under 35 U.S.C. 154(b) by 226 days.

(21) Appl. No.: 12/203,844

(22) Filed: Sep. 3, 2008

Related U.S. Application Data

(60) Provisional application No. 60/970,063, filed on Sep. 5, 2007.

(51) Int. Cl.
*E02F 5/00* (2006.01)

(52) U.S. Cl. ..... 414/722; 414/912; 37/409; 37/901

(58) Field of Classification Search ..... 414/722, 414/726, 725, 912; 37/409, 403, 408, 901
See application file for complete search history.

(56) References Cited

U.S. PATENT DOCUMENTS 4,566,844 A * 1/1986 Campin ..... 414/726
4,633,601 A * 1/1987 Fleck et al. ..... 37/444

* cited by examiner

*Primary Examiner*—Donald Underwood
(74) *Attorney, Agent, or Firm*—Miller Law Group, PLLC

(57) ABSTRACT

A control apparatus for a bucket loader allows a single linear actuator to provide multiple operative functions for the bucket loader. A selector link is pivotally mounted on the back plate of loader bucket to selectively connect the back plate to the base portion of the linear actuator so that the extendable portion powers a pivoting of the bucket shell to dump material from the bucket, or connect the back plate to the extendable portion of the linear actuator to power the vertical movement of the back plate. A chain interconnects the extendable portion of the linear actuator and the pivotable bucket shell to power the pivoting of the bucket shell when the selector link is connected to the base portion. The bucket shell can be mechanically locked into an open position to allow the back plate to be utilized as a push blade.

20 Claims, 13 Drawing Sheets

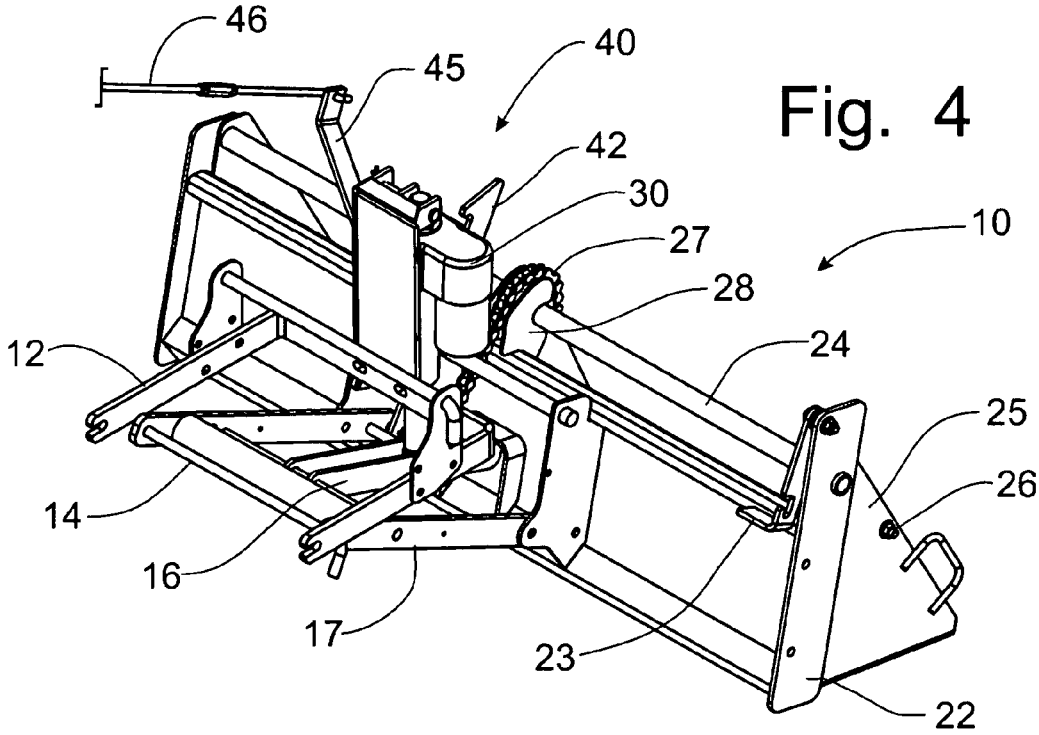
Fig. 4
Fig. 5
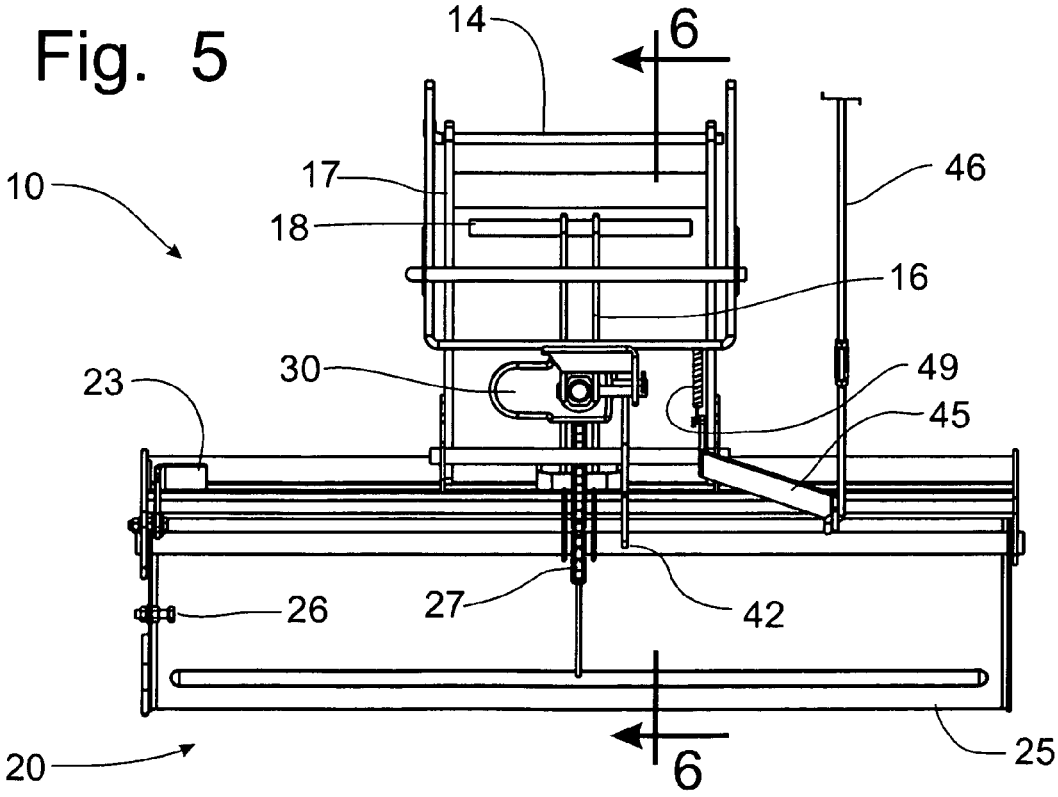

BUCKET LOADER FOR SMALL TRACTORS AND ALL TERRAIN VEHICLES

CROSS-REFERENCE TO RELATED APPLICATIONS

This application claims domestic priority on U.S. Provisional Patent Application Ser. No. 60/970,063, filed on Sep. 5, 2007, the contents of which are incorporated herein by reference.

FIELD OF THE INVENTION

This invention relates generally to bucket loaders that are optionally mounted on small tractors to provide a material handling capability, and more particularly, to a bucket loader that is operable to perform multiple functions utilizing a single actuator.

BACKGROUND OF THE INVENTION

Bucket loaders are an optional attachment that can be mounted on tractors to provide material handling capability. The bucket loader typically has a frame that is detachably supported on the tractor, a pair of forwardly extending boom arms pivotally mounted on the frame, and a bucket pivotally supported on the forward ends of the boom arms to engage material forwardly of the tractor. The bucket is typically pivotable to scoop material, moving the front edge of the bucket up and down, while the pivotally movable boom arms are operable to raise and lower the bucket.

The tractor providing motive and operational power for the bucket loader can be substantially any size from the large farm tractors to the small garden tractors that are often used to mow lawns in a residential setting. Large tractors have onboard hydraulic systems that are used to power hydraulic cylinders mounted on the bucket loader to cause pivotal movement of the components thereof. The smaller garden tractors do not typically carry onboard hydraulic systems, requiring any actuators powering the pivotally movable components of the bucket loader to be electrical, rather than hydraulic. All terrain vehicles (ATV), sometimes referred to as four-wheelers, can also have small bucket loaders mounted on them to increase the versatility and flexibility of operation thereof. Each operable function of the bucket loader conventionally requires a separate actuator. The boom lift function, particularly on large tractors, is powered by a pair of hydraulic cylinders, one positioned on each boom arm. The pivotal movement of the bucket relative to the boom arms is normally powered by a separate actuator.

Bucket loaders for small garden tractors and ATV's are usually constructed somewhat differently than the bucket loaders for large tractors. First, the overall size of the bucket loader apparatus is substantially smaller, as the bucket, boom arms and frame are sized to be adapted to the smaller garden tractor configuration. Since the bucket is relatively small and has a relatively small load capacity, the tilt function for the bucket can be operated and powered manually, reserving the actuator power for lifting the boom arms and the attached bucket. The pivotal range of such buckets, however, is limited, often resulting in the retention of some of the material loaded into the bucket when the bucket is tipped to empty the material from the bucket.

Split bucket configurations, often referred to as clamshell buckets, are known for larger bucket loader configurations, but are not particularly adaptable to the small bucket loaders because of the need to power the operation of the pivoted forward shell portion of the bucket relative to the rearward back plate portion on which the shell portion is pivotally mounted. The clamshell bucket has the extra advantage of being capable of opening the forward shell portion of the bucket to expose the back plate portion and enable the back plate portion to be operated as a blade to push material around, rather than lift the material in the bucket function.

It would be desirable to provide a bucket loader that would provide a clamshell bucket configuration for use on a small tractor or other vehicle. It would also be desirable to provide a linkage mechanism that would enable a single actuator to perform multiple functions on the bucket loader, particularly the functions of lifting the bucket and operating the clamshell bucket apparatus.

SUMMARY OF THE INVENTION

It is an object of this invention to overcome the disadvantages of the prior art by providing a bucket loader for a small tractor in which multiple operative functions of the bucket are controlled through a single linear actuator.

It is another object of this invention to provide a control mechanism to cooperate with a single linear actuator to control multiple operative functions of a bucket loader.

It is a feature of this invention that the linear actuator is connected to a lift linkage that is cooperable with a selector link to control the effect of the extension of the linear actuator.

It is an advantage of this invention that the single linear actuator can control the operation of the bucket between digging and dumping functions.

It is another feature of this invention that the selector link is coupled to the extendable ram of the linear actuator to move the bucket up and down.

It is still another feature of this invention that the selector link is coupled to the base portion of the linear actuator to secure the back plate of the bucket with the base portion of the linear actuator so that the extension of the movable ram will affect a pivotal movement of the bucket shell relative to the back plate.

It is another advantage of this invention that the extendable portion of the linear actuator is connected to the bucket shell by a flexible member, such as a chain, to affect movement of the bucket shell when the back plate is secured to the base portion of the linear actuator.

It is still another advantage of this invention that the bucket shell is pivotally mounted to the back plate of the loader bucket to permit movement of the bucket shell relative to the back plate to allow material positioned within the loader bucket to be dumped therefrom.

It is yet another feature of this invention that the bucket shell can be locked into an open position to allow the back plate to be utilized as a blade member to push material.

It is still another feature of this invention that the selector link connected to the extendable portion of the linear actuator will function to move the back plate vertically in response to movement of the extendable portion of the linear actuator while the bucket shell is locked into an open position.

It is yet another advantage of this invention that the movement of the selector link is controlled by an actuator handle that is positioned for manipulation by the operator seated on the seat of the small tractor.

It is still another advantage of this invention that the linear actuator can be powered electrically.

It is still another object of this invention to provide a bucket loader for a small tractor which is durable in construction, inexpensive of manufacture, carefree of maintenance, facile in assemblage, and simple and effective in use.

These and other objects, features and advantages are accomplished according to the instant invention by providing a control apparatus for a bucket loader that allows a single linear actuator to provide multiple operative functions for the bucket loader. A selector link is pivotally mounted on the back plate of loader bucket to selectively connect the back plate to the base portion of the linear actuator so that the extendable portion powers a pivoting of the bucket shell to dump material from the bucket, or connect the back plate to the extendable portion of the linear actuator to power the vertical movement of the back plate. A chain interconnects the extendable portion of the linear actuator and the pivotable bucket shell to power the pivoting of the bucket shell when the selector link is connected to the base portion. The bucket shell can be mechanically locked into an open position to allow the back plate to be utilized as a push blade.

BRIEF DESCRIPTION OF THE DRAWINGS

The advantages of this invention will become apparent upon consideration of the following detailed disclosure of the invention, especially when taken in conjunction with the accompanying drawings wherein:

FIG. 4 is a right rear perspective view of the bucket loader shown in FIG. 1 with the actuator handle being broken away for purposes of clarity;

FIG. 5 is a top plan view of the bucket loader shown in FIG. 4;

DETAILED DESCRIPTION OF THE INVENTION

Figure 1:
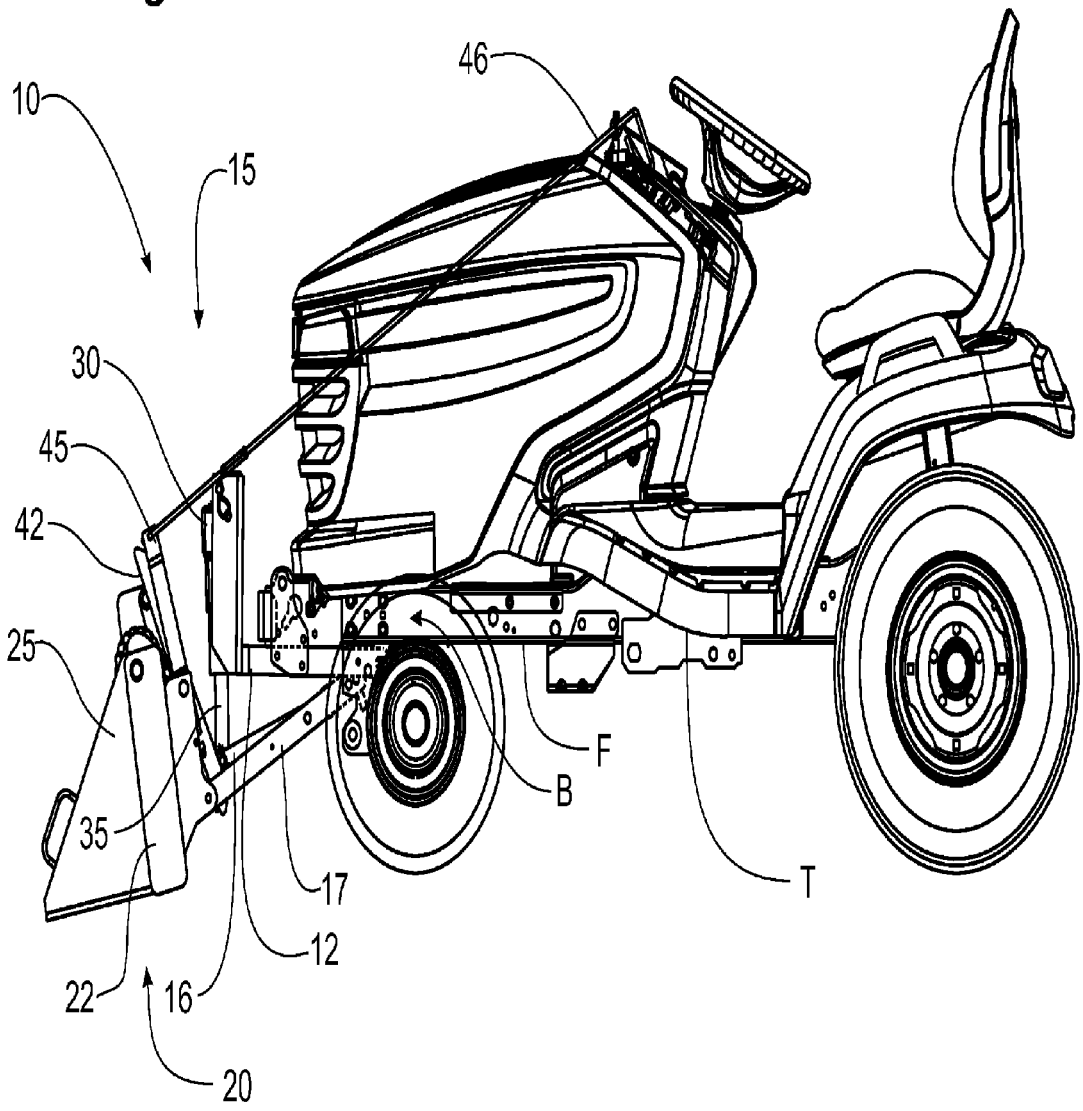
FIG. 1 is a left side elevational view of a bucket loader incorporating the principles of the instant invention mounted on a small garden tractor, the bucket being shown in the lowered material engaging position.
Figure 2:
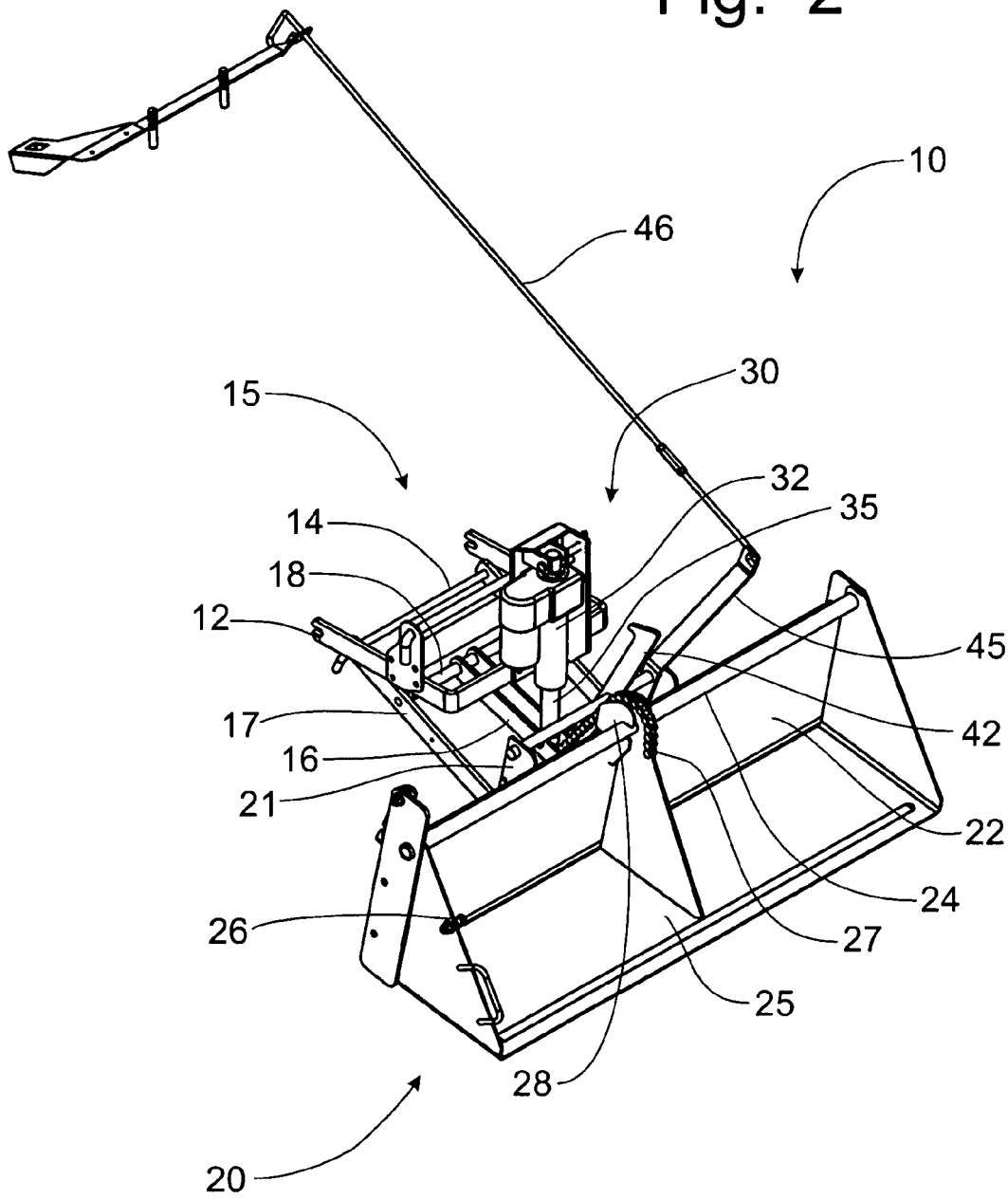
FIG. 2 is an upper right front perspective view of the bucket loader shown in FIG. 1.
Figure 3:
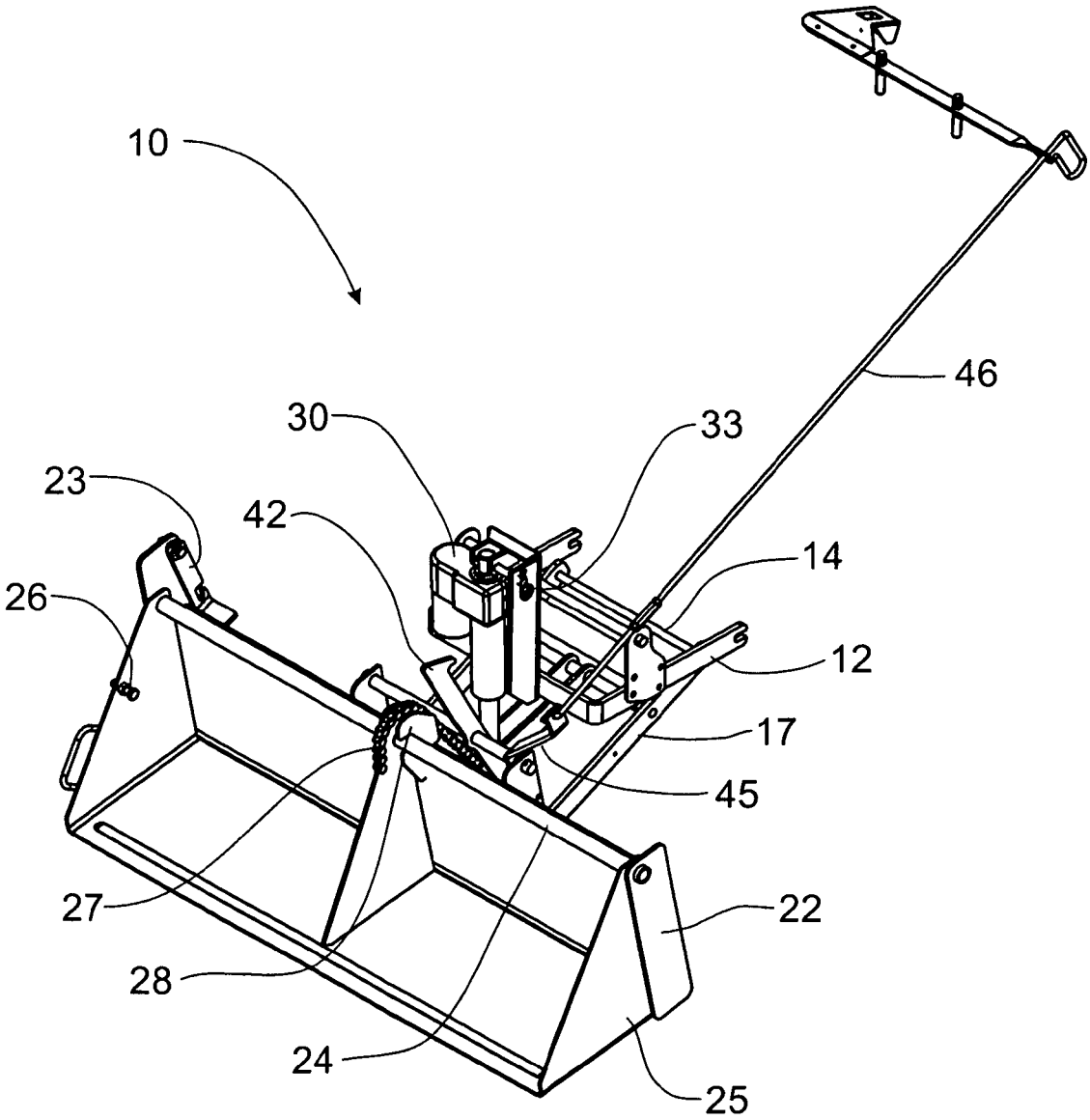
FIG. 3 is an upper front left perspective view of the bucket loader shown in FIG. 1.

Referring now to the drawings, the structural components of the bucket loader apparatus 10 can best be seen. Any left and right references are used as a matter of convenience and are determined by standing at the rear of the garden tractor T and facing the forward direction, the normal direction of travel, with the bucket loader being mounted at the forward end of the garden tractor T. One skilled in the art will understand that the principles of the instant invention are not limited to a bucket loader apparatus 10 that is mounted on a small garden tractor T, and could be applied to a bucket loader that is supported on a much larger tractor or other prime mover (not shown), such as an all terrain vehicle (ATV). Since the preferred embodiment is a bucket loader apparatus 10 that is mounted on a small garden tractor T, this is the embodiment shown in the drawings.

The bucket loader apparatus 10 includes a mounting frame 12 that is connected to the frame F of the garden tractor T, which is typically provided with mounting brackets B for the purpose of mounting attachments, such as blades, snow blowers, mowers, etc. Thus, the mounting frame 12 is fixed relative to the tractor T and provides a base from which the remaining components of the bucket loader apparatus 10 can operate. A lift mechanism 15 is pivotally supported on the mounting frame 12 at pivot 14 and includes a centrally located lift arm 16 and a pair of laterally spaced boom arms 17 that are connected to the bucket 20. A transverse connecting link 18 interconnects the laterally spaced boom arms 17 to provide a pivot axis for the central lift arm 16.

The bucket 20 is formed as a clamshell bucket that has a back plate 22 carrying a support bracket 21 to which the lift mechanism 15 is connected. A bucket shell 25 is pivotally mounted on the back plate 22 by a rock shaft 24 such that the bucket shell 25 is pivotally movable between a lowered bucket-forming position next to the back plate 22, as is shown in FIGS. 1-8, and a raised blade-forming position, as is depicted in FIGS. 9-12. The pivotal movement of the bucket shell 25 is affected through a chain 27 connected to the bucket shell 25 at a central location thereon, wrapping around a guide bracket 28 fixed on the rock shaft 24 and extending downwardly therefrom for connection to the lift mechanism 15 for operation as will be described in greater detail below. The central lift arm 16 extends forwardly into engagement with the support bracket 21, but located below the support bracket 21 such that the central lift arm 16 is operable to lift vertically the support bracket 21 and the attached back plate 22. As is best seen in FIGS. 3-5 and 12, the back plate 22 carries a lock member 23 at a transverse end thereof to be selectively engagable with a connector 26 carried by the bucket shell 25 to restrain the bucket shell 25 in the raised blade forming position.

The mounting frame 12 supports an actuator 30 that is oriented generally vertically at a forward central location on the mounting frame 12. The actuator 30 can be hydraulically or electrically operated, though for small tractors, such as the garden tractor T, the actuator 30 is preferably electrically operated so as to be connected to the electrical system of the tractor T. Preferably, the actuator 30 is associated with a housing 32 that is physically connected to the mounting frame 12 with the housing 32 supporting the actuator 30 which includes a body portion mounted in the housing 32 and an extendable piston 35 that preferably extends downwardly from the body portion. The housing 32 carries an upper pin 33 connecting the body portion of the actuator 30 to the housing 32 and a lower pin 34 connecting the distal end of the piston 35 to the central lift arm 16 of the lift mechanism 15. Thus, the lift mechanism 15 moves vertically in conjunction with the extension and contraction of the piston 35 relative to the body portion of the actuator 30.

The bucket loader apparatus 10 further includes a selector linkage 40 that is manually operable by the operator (not shown) seated on the tractor T. The selector link 42 is affixed to a pivot shaft 41 so as to be pivotally movable therewith. The pivot shaft 41 also has manipulator arm 45 connected thereto to cause pivotal rotation of the pivot shaft 41. The manipulator arm 45 is connected to an actuation link 46 that extends rearwardly therefrom for access by the operator seated on the tractor T. When the operator pulls the actuator link 46 rearwardly, the manipulator arm 45 rotates the pivot shaft 41 so that the top portion of the selector link 42 moves rearwardly, while the bottom portion of the selector link 42 moves forwardly. A tension spring 49, shown in FIG. 5, is anchored on the adjacent boom arm 17 and is connected to an extension of the manipulator arm 45 positioned below the pivot shaft 41 to bias the manipulator arm 45, and the associated selector link 42, such that the top portion of the selector link 42 is urged forwardly. As a result, the selector link 42 is biased such that the lower retainer hook 44 is in engagement with the lower pin 34.

The selector link 42 is formed with an upper retainer hook 43 on the top portion of the selector link 42 and with a lower retainer hook 44 on the bottom portion of the selector link 42. The upper retainer hook 43 of the selector link 42 is engagable with the upper pin 33 when the top portion of the selector link 42 is pivoted rearwardly, while the lower retainer hook 44 is engagable with the lower pin 34 when the top portion of the selector link 42 is pivoted forwardly. In operation, the engagement between the lower retainer hook 44 and the lower mounting pin 34 operatively couples the central lift arm 16 to the supporting bracket 21, and thus to the back plate 22, to cause vertical movement of the back plate 22. Alternatively, the engagement between the upper retainer hook 43 and the upper pin 33 fixes the back plate 22 to the housing 32 and the mounting frame 12 on which the housing 32 is affixed, leaving the central lift arm 16 to move downwardly relative to the back plate 22 away from the support bracket 21.

Figure 6:
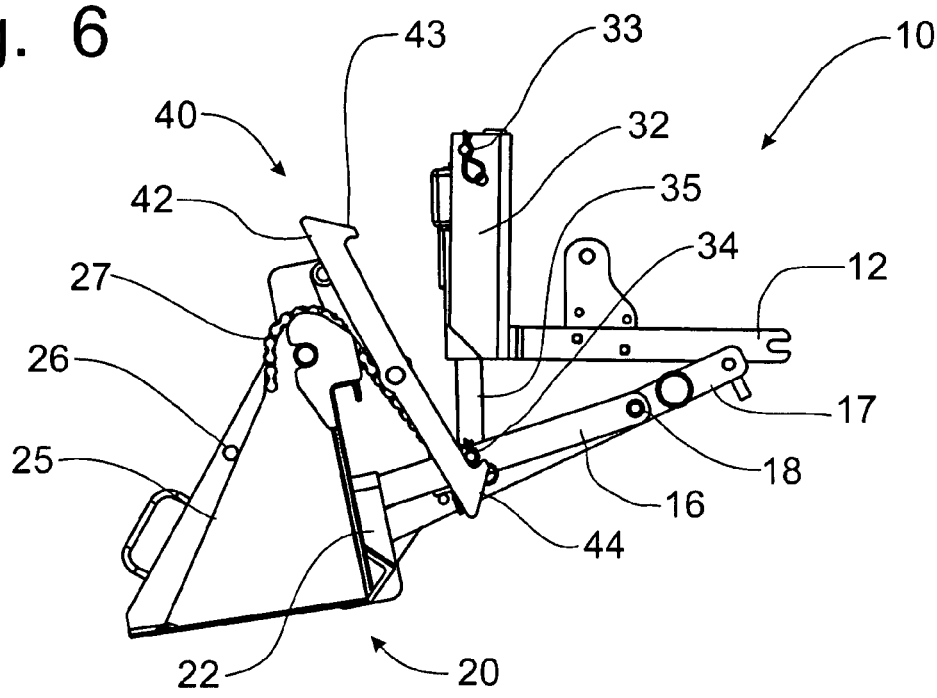
FIG. 6 is a cross-sectional view of the bucket loader taken along lines 6-6 in FIG. 5 to show an elevational view of the selector link, the linear actuator and the lift mechanism, the loader bucket being in a lowered material engaging position.
Figure 11:
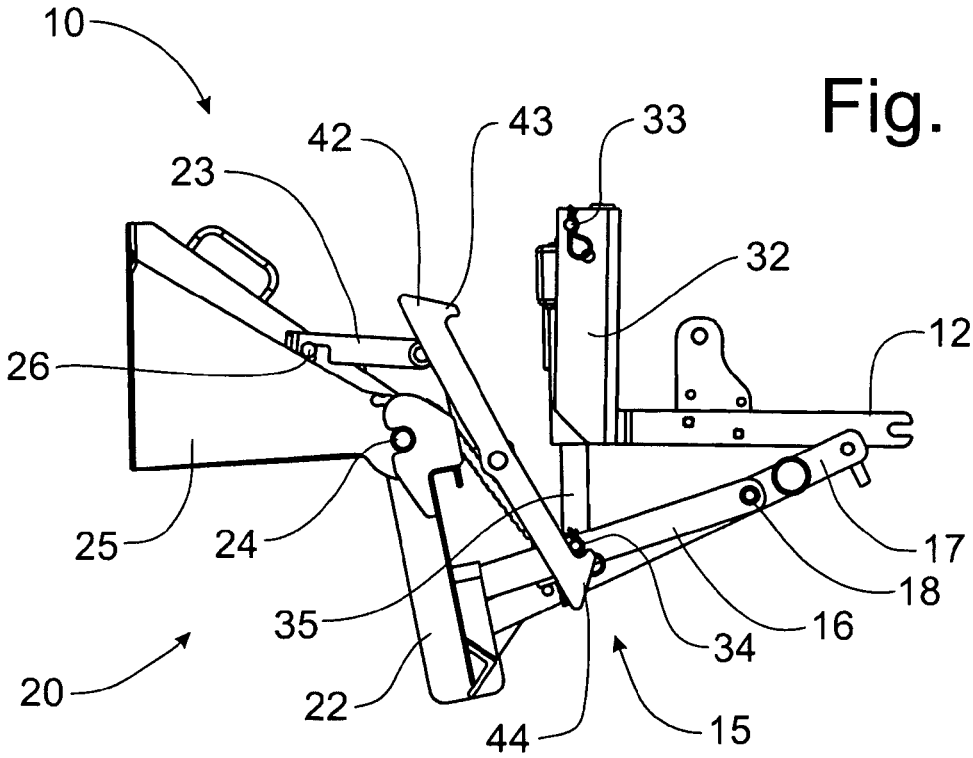
FIG. 11 is a cross-sectional view of the bucket loader similar to that of FIG. 10, but showing the operation of the back plate as a push blade.
Figure 12:
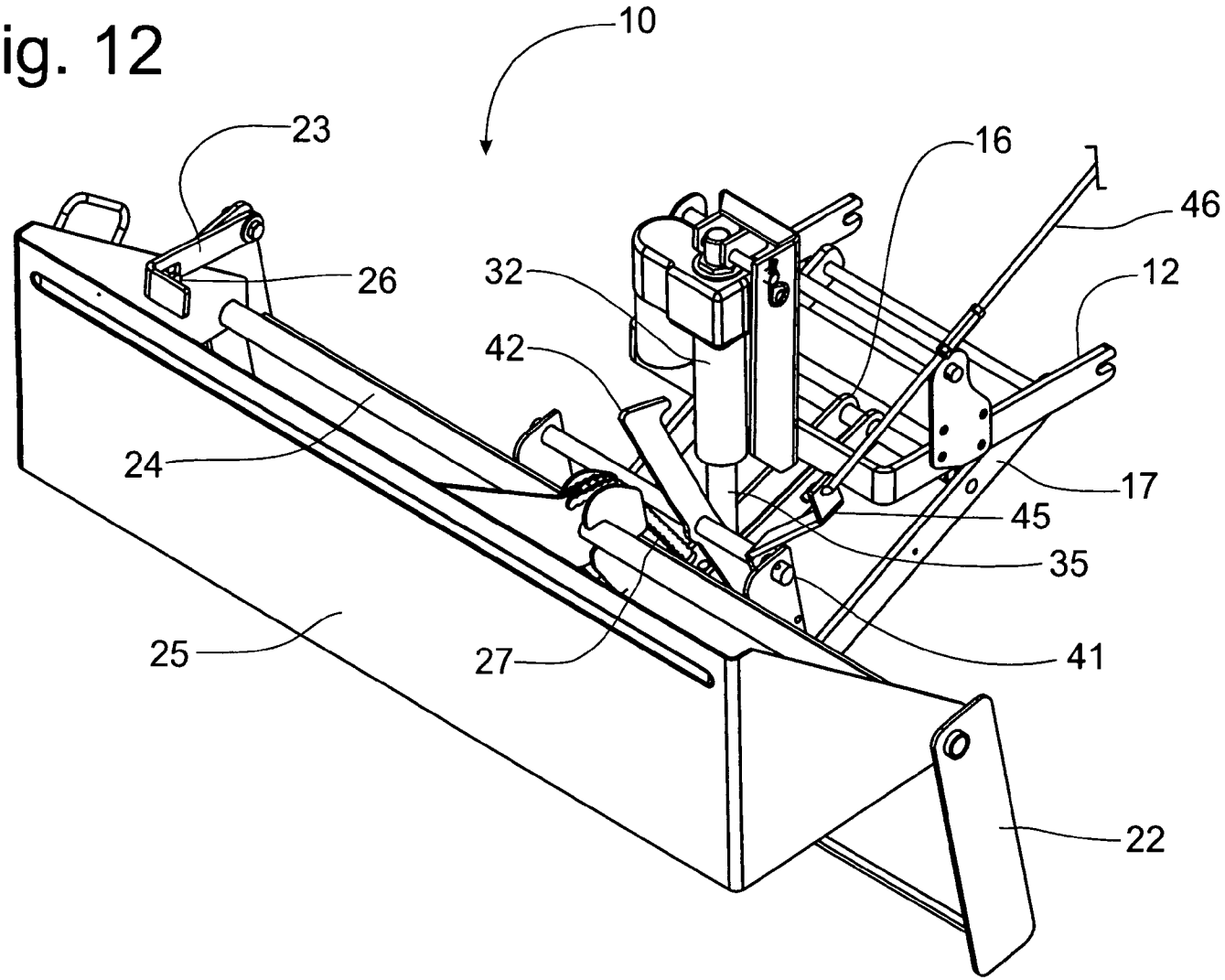
FIG. 12 is a upper left front perspective view of the bucket loader in the push blade configuration shown in FIG. 11, the actuator handle being broken away for purposes of clarity.
Figure 13:
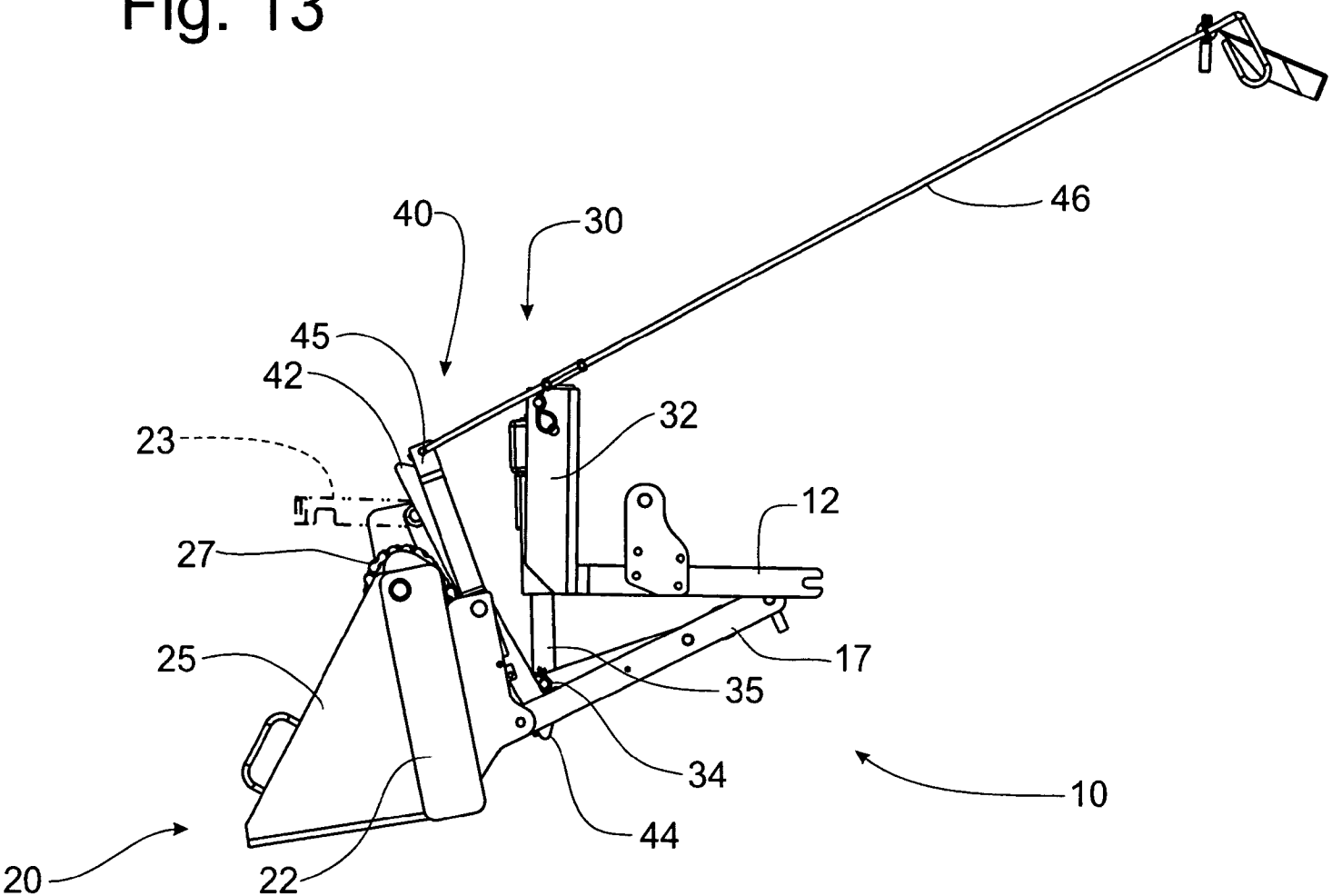
FIG. 13 is a side elevational view of the bucket loader with the bucket being down in a loading position next to the ground.

The normal operation of the bucket loader 10 to load into and unload material from the bucket 20 can best seen in FIGS. 6-17. Referring first to FIGS. 6 and 13, the selector link 42 is pivoted so that the lower retainer hook 44 is engaged with the lower pin 34 to operatively couple the lift mechanism 15 to the bucket 20. The piston 35 is extended from the body portion of the actuator 30 to drive the bucket 20 onto the surface of the ground. In fact, the actuator 30 can place substantial down pressure on the bucket 20 to force the bucket 20 onto the ground. The tractor is then driven into the material to be loaded (not shown) so that the bucket 20, with the bucket shell 25 placed into the lowered bucket-forming position, is filled with the material.

Figure 7:
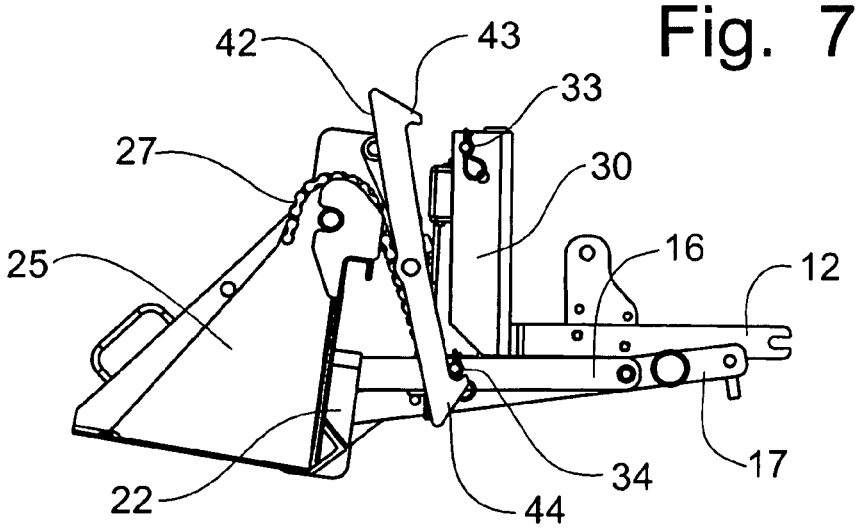
FIG. 7 is a cross-sectional view of the bucket loader similar to that of FIG. 6, but showing the loader bucket ins a raised position as though to elevate material gathered into the loader bucket.
Figure 8:
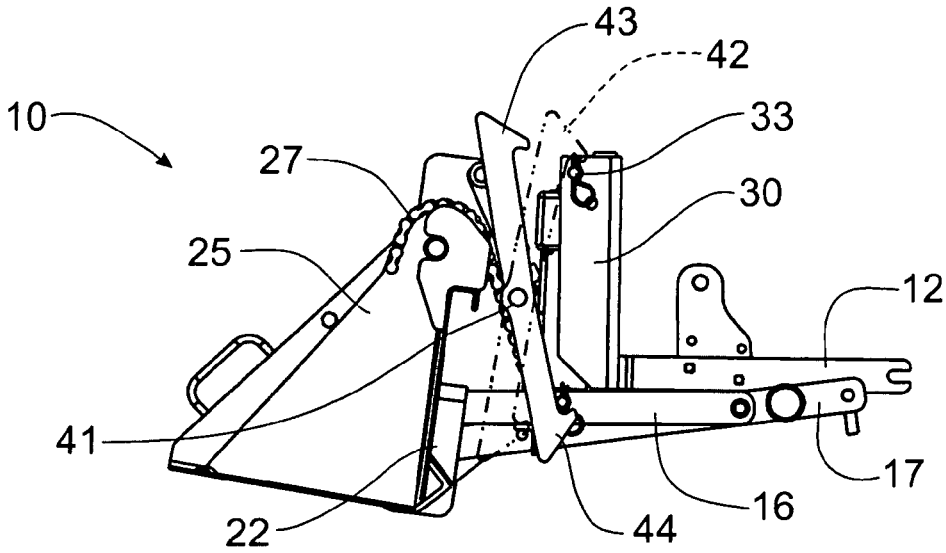
FIG. 8 is a cross-sectional view of the bucket loader similar to that of FIG. 7 but showing the movement of the selector link in phantom to change the operative effect of the linear actuator.
Figure 9:
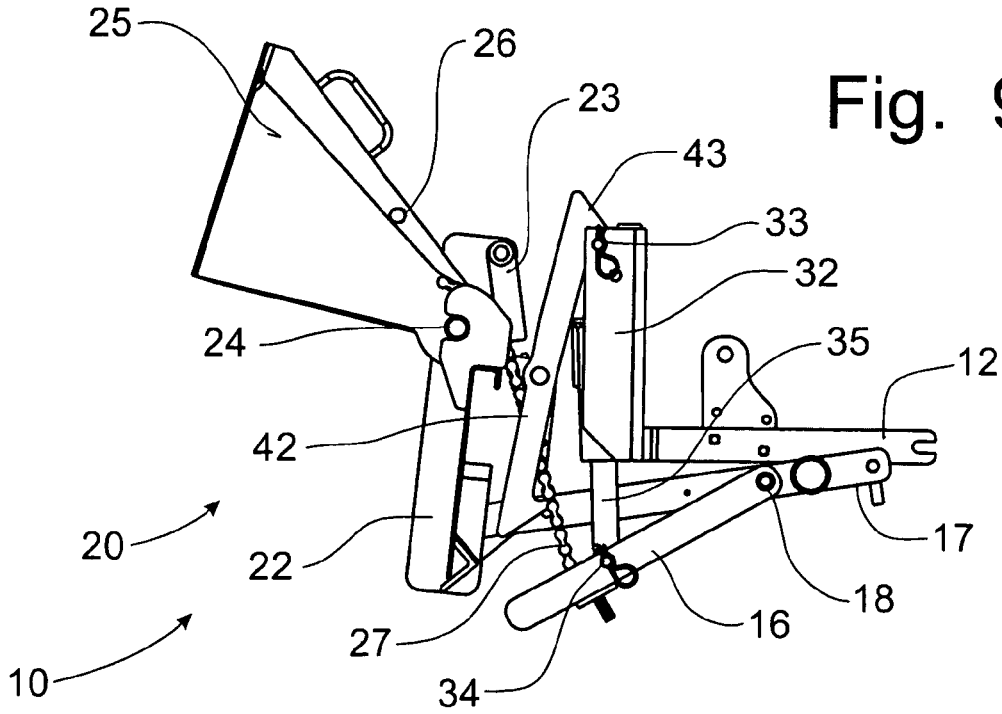
FIG. 9 is a cross-sectional view of the bucket loader similar to that of FIG. 6, but showing the operative function of pivoting the bucket shell to dump the material collected in the loader bucket by virtue of moving the selector link into engagement with the base portion of the linear actuator.
Figure 14:
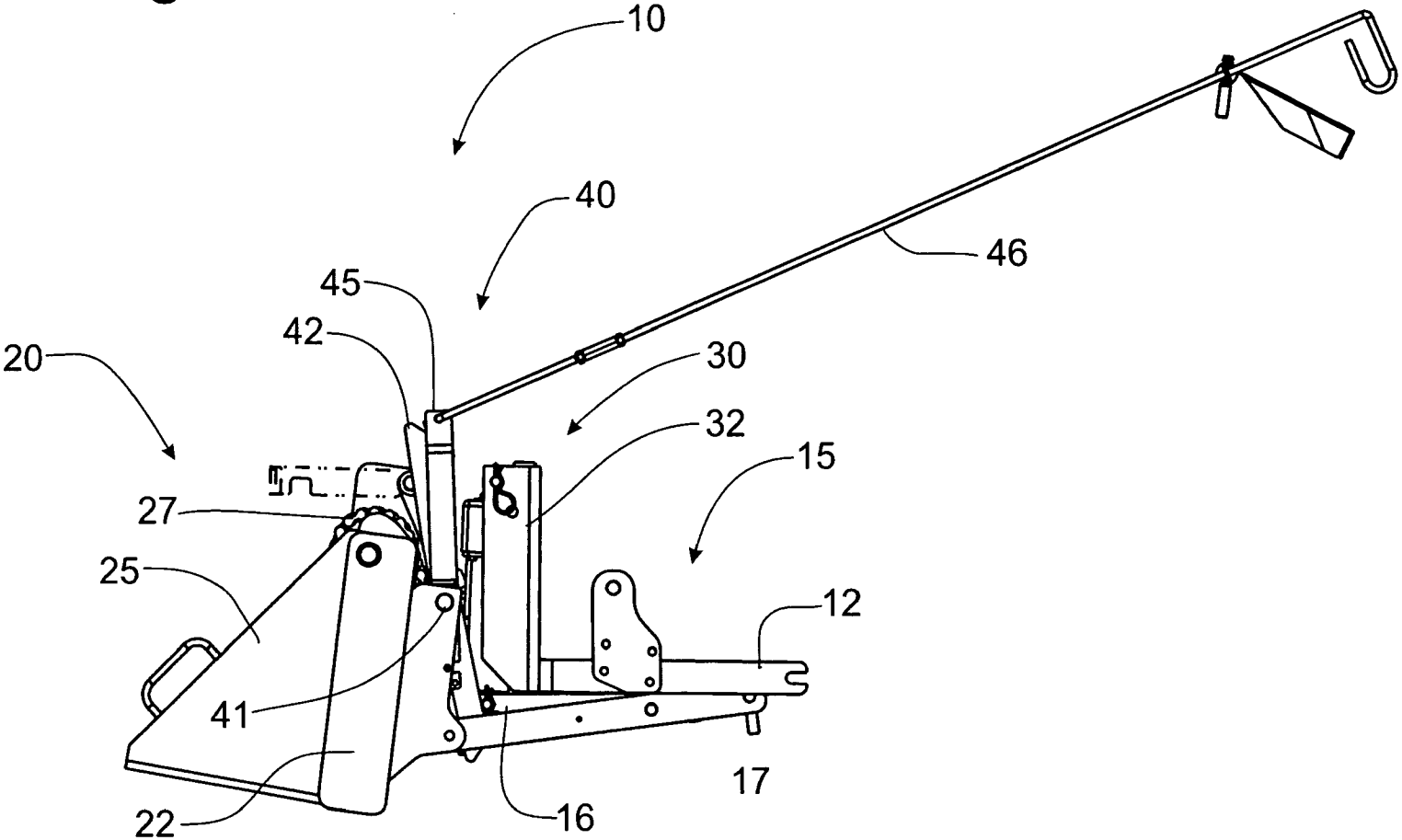
FIG. 14 is a side elevational view of the bucket loader shown in FIG. 13 with the bucket being raised off the ground.
Figure 15:
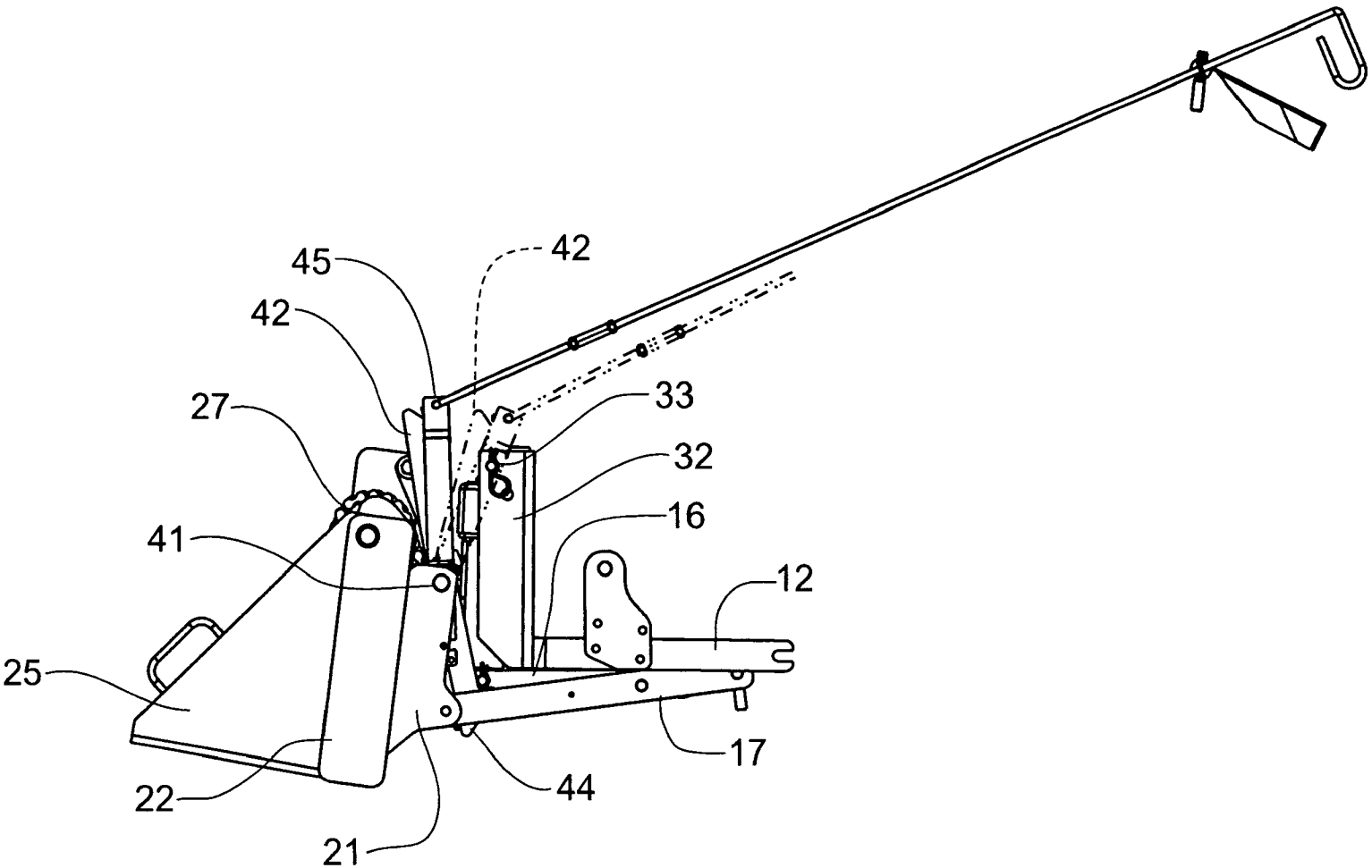
FIG. 15 is a side elevational view of the bucket loader shown in FIG. 14 with the movement of the selector link being shown in phantom.

As is reflected in FIGS. 7 and 14, the piston 35 is retracted into the body portion of the actuator 30 so that the central lift arm 16 lifts the support bracket 21, drawing the boom arms 17 and the attached bucket 20 upwardly. Once the piston 35 is fully, or substantially fully, retracted, the manipulator arm 45 is pulled rearwardly pivoting the selector link 42, as depicted in FIGS. 8 and 15, so that the upper retainer hook 43 becomes engaged with the upper pin 33. The lifting of the support bracket 21 by the central lift arm 16 takes the pressure off of the selector link 42 so that the manipulator arm 45 is able to cause a pivotal movement of the selector link 42. With the back plate 22 secured to the housing 32 by the engagement of the upper retainer hook 43 with the upper pin 33, the subsequent downward movement of the piston 35 lowers the central lift arm 16 with the chain 27 connected thereto, affecting a corresponding upward pivotal movement of the bucket shell 25 from the lowered bucket-forming position. The separation of the bucket shell 25 from the back plate 22 with the back plate raised into an elevated position, secured by the selector link 42, effectively causes the material to be dumped from the bucket 20, as is represented in FIGS. 9 and 16.

A recycling of the piston 35 back into the body portion of the actuator 30 allows the bucket shell 25, powered by gravity, but operatively controlled by the upwardly moving chain 27 connected to the central lift arm 16, to return to the bucket-forming position adjacent the back plate 22. Once the piston 35 has been retracted into the body portion of the actuator 30, the selector link 42 can be pivoted forwardly, urged by the biasing tension spring 49, to allow the subsequently extending piston 35 to lower the bucket 20 back to the ground with the bucket shell 25 lowered against the back plate 22. Accordingly, the actuator 30 is used to perform two independent tasks as determined by the positioning of the selector link 42. Thus, the bucket 20 can be used to scoop loose material and make an effective emptying of the bucket 20 by separating the bucket shell 25 from the back plate 22 through a recycling of the actuator 30.

Figure 10:
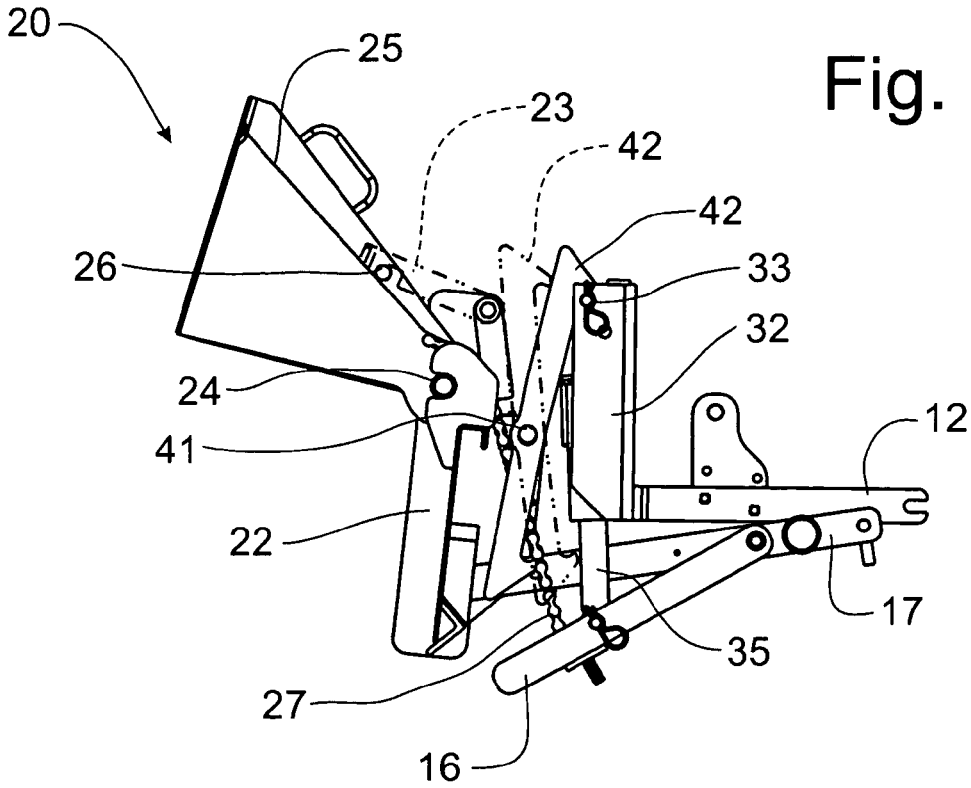
FIG. 10 is a cross-sectional view of the bucket loader similar to that of FIG. 9, but showing the movement of the lock member in phantom to secure the bucket shell in an open position, and the movement of the selector link in phantom to reconnect the back plate to the extendable portion of the linear actuator.
Figure 16:
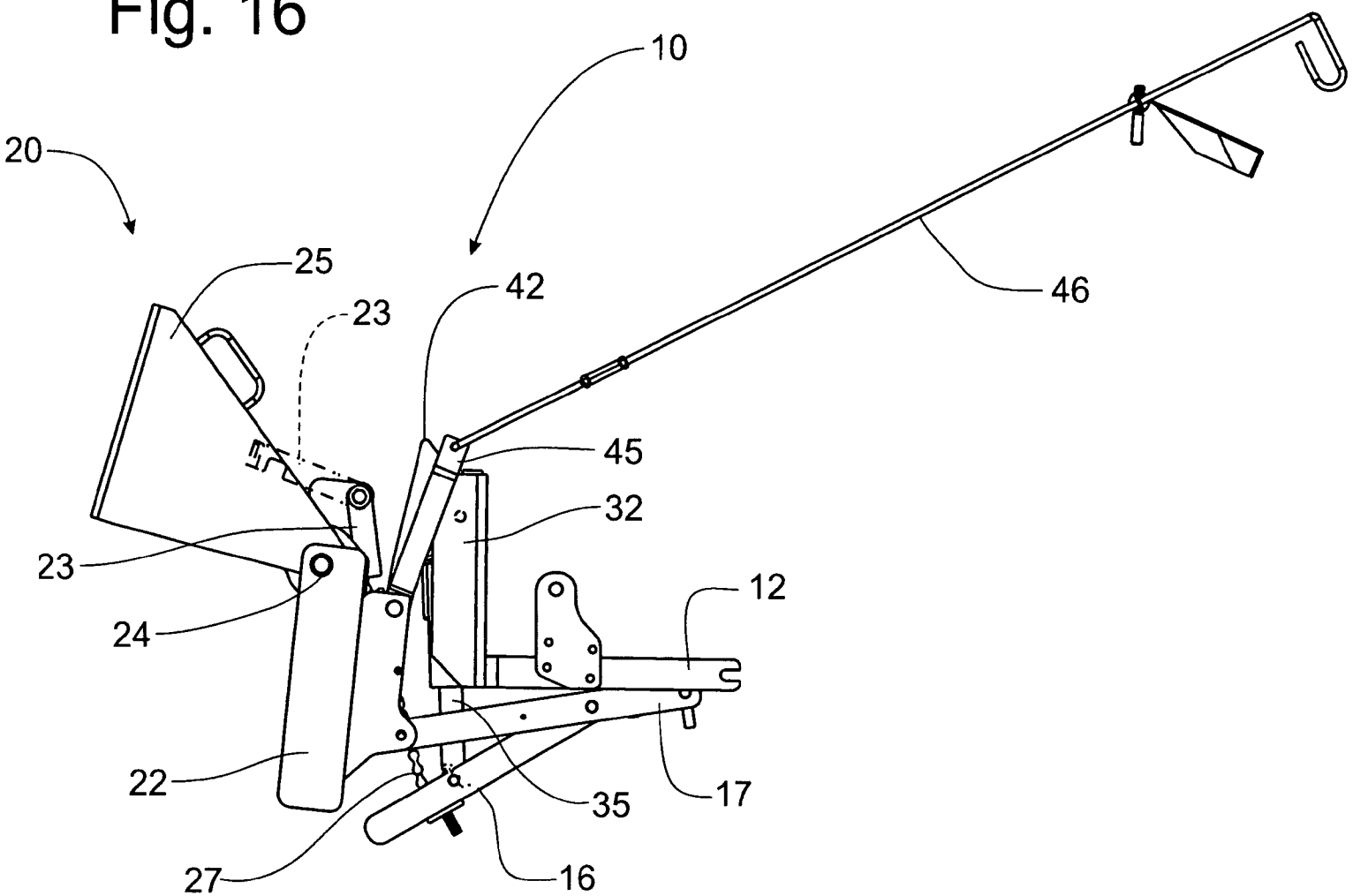
FIG. 16 is a side elevational view of the bucket loader shown in FIG. 15 with the shell portion of the clam shell bucket being opened while the boom arms are fully raised to affect a dumping of any material gathered in the loader bucket.
Figure 17:
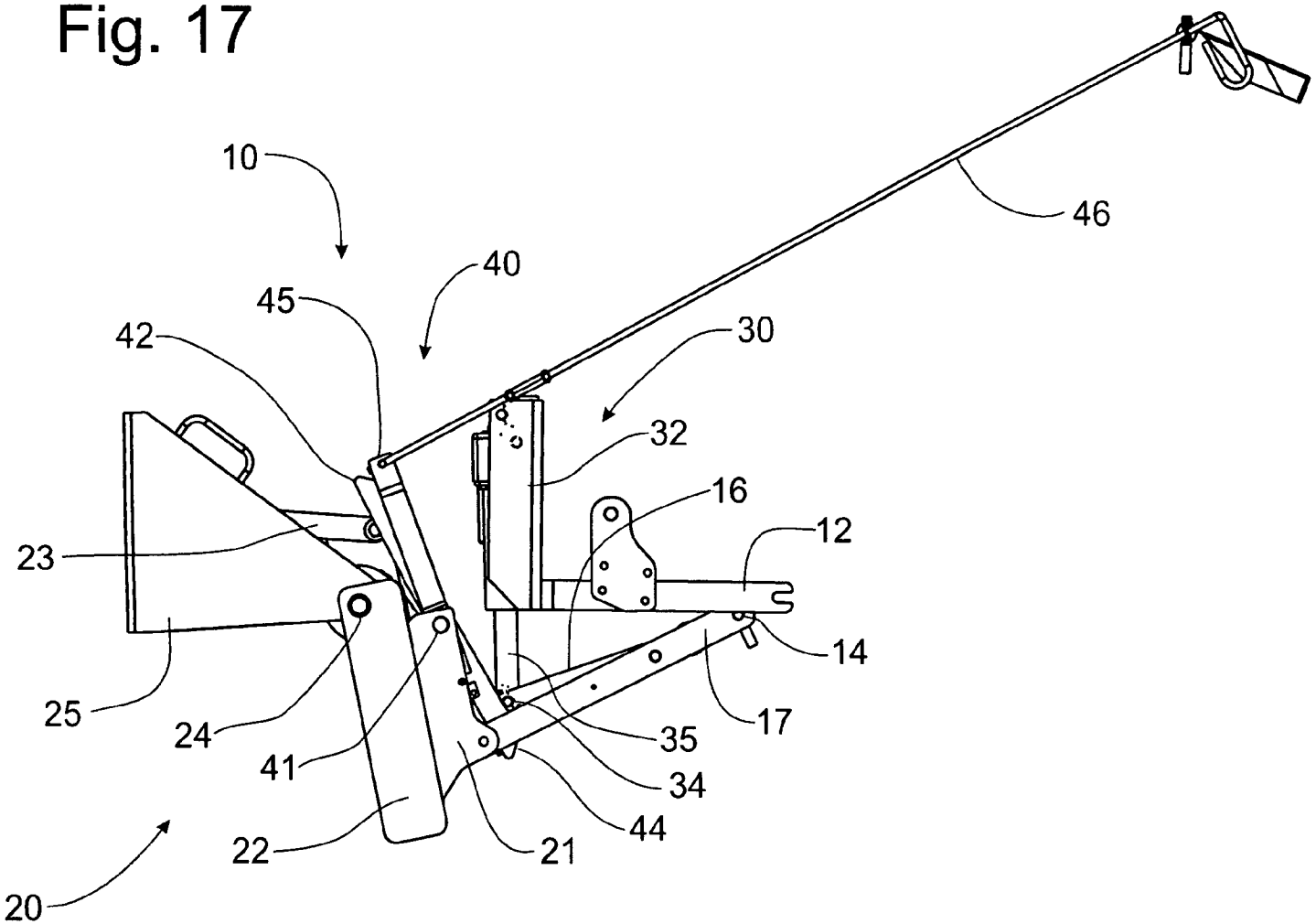
FIG. 17 is a side elevational view of the bucket loader shown in FIG. 16 with the clamshell bucket being locked in the fully opened position and the back plate being used as a push blade.

When the bucket 20 has been lifted and the actuator 30 has been recycled to open the bucket shell 25, as described above, the lock member 23 can be pivoted on the back plate 22 to engage the connector 26 on the side of the bucket shell 25 to lock the bucket shell 25 in the raised position, as is represented in FIGS. 10 and 16. In this orientation, the piston 35 of the actuator 30 is extended to draw the chain 27 downwardly to open the bucket shell 25. A subsequent retraction of the piston 35 into the body portion of the actuator 30 accomplishes nothing but allowing the selector link 42 to be pivoted so that the subsequent extension of the piston 35 will lower the bucket 20 back to the ground. Since, however, the bucket shell 25 is locked in the opened position by the lock member 23, the bucket 20 is lowered with the back plate 22 exposed as a blade so that the back plate 22 can be utilized to push material around without scooping the material into the bucket 20, as is shown in FIGS. 11, 12 and 17.

To return the bucket 20 to a bucket configuration, instead of the blade configuration, the piston 35 is again retracted into the body portion of the actuator 30 to raise the bucket 20 until the selector link 42 can be pivoted so that the top retainer hook 43 engaged with the upper pin 33. The subsequent extension of the piston 35 from the actuator 30 extends the chain 27 to take the weight off the lock member 23 and allow the lock member to be released from the connector 26. A subsequent retraction of the piston 35 allows the bucket shell 25 to return to the lowered position against the back plate 22. Then, a pivoting of the selector link 42 to engage the lower retainer hook 44 with the lower pin 34 allows the extension of the piston 35 to lower the bucket 20 to the ground in the bucket configuration.

It will be understood that changes in the details, materials, steps and arrangements of parts which have been described and illustrated to explain the nature of the invention will occur to and may be made by those skilled in the art upon a reading of this disclosure within the principles and scope of the invention. The foregoing description illustrates the preferred embodiment of the invention; however, concepts, as based upon the description, may be employed in other embodiments without departing from the scope of the invention.

Having thus described the invention, what is claimed is:

1. A bucket loader mountable on a prime mover comprising:

a frame securable to the prime mover to be mounted thereon;

a linear actuator supported on said frame and having a base housing and an extendable piston;

a lift linkage pivotally supported on said frame for vertical movement relative thereto, said lift linkage being connected to said linear actuator to power said vertical movement;

a loader bucket pivotally supported from said frame, said loader bucket having a base plate and a bucket shell pivotally connected to said base plate; and a selector link mounted on said loader bucket and being selectively engagable with said linear actuator to be configured in a first mode of operation to cause vertical movement of said loader bucket and in a second mode of operation to cause pivotal movement of said bucket shell relative to said base plate.

2. The bucket loader of claim 1 wherein said selector link is selectively engagable with said piston when in said first mode of operation and with said base housing when in said second mode of operation.

3. The bucket loader of claim 2 further comprising a connector link interconnecting said bucket shell and said piston.

4. The bucket loader of claim 3 wherein said loader bucket includes boom arms pivotally connected to said frame, said lift linkage being pivotally mounted on said boom arms.

5. The bucket loader of claim 3 wherein said selector link is formed with an upper retainer hook engagable with said base housing of said linear actuator and a lower retainer hook engagable with said piston, said selector link being pivotable about a pivot axis positioned between said upper and lower retainer hooks.

6. The bucket loader of claim 5 wherein said selector link is manually moved about said pivot axis by manipulation of an actuator handle, said selector link being biased by a spring to engage said lower retainer hook with said piston.

7. The bucket loader of claim 3 wherein said base plate carries a lock member selectively movable into engagement with said bucket shell to lock said bucket shell into an open position.

8. The bucket loader of claim 7 wherein said selector link is selectively engagable with said piston when said lock member is engaged with said bucket shell to move said loader bucket vertically to function as a push blade.

9. The bucket loader of claim 3 wherein said linear actuator is operable to exert down pressure on said loader bucket when said selector link is in said first mode of operation.

10. In a bucket loader mountable to a prime mover and having a clam shell bucket formed with a base plate and a bucket shell pivotally connected to said base plate, said loader bucket including boom arms pivotally supporting said loader bucket for vertical movement, the improvement comprising:

a linear actuator affixed to a frame detachably connected to said prime mover, said linear actuator having a base housing and a piston extendable from said base housing; and a selector link mounted on said base plate and being engagable with said linear actuator in a first mode of operation to cause vertical movement of said loader bucket and in a second mode of operation to cause pivotal movement of said bucket shell relative to said base plate.

11. The bucket loader of claim 10 further comprising a link member operably interconnecting said piston and said bucket shell, the extension of said piston causing said bucket shell to pivot relative to said base plate through said link member when said selector link is in said second mode of operation.

12. The bucket loader of claim 11 wherein said selector link is engagable with said piston when in said first mode of operation and engaged with said base housing when in said second mode of operation.

13. The bucket loader of claim 12 further comprising a lift linkage pivotally supported from said boom arms and connected to said piston, said linear actuator being operable to exert down pressure on said clam shell bucket through said selector link when in said first mode of operation.

14. The bucket loader of claim 12 wherein said base plate includes a lock member selectively engagable with said bucket shell when in a raised open position relative to said base plate to lock said bucket shell in said raised open position.

15. The bucket loader of claim 12 wherein said selector link is formed with an upper retainer hook engagable with an upper pin corresponding to said base housing of said linear actuator and a lower retainer hook engagable with a lower pin on said piston, said selector link being pivotable about a pivot axis positioned between said upper and lower retainer hooks.

16. A method of operating a bucket loader having a clam shell bucket including a base plate and a bucket shell pivotally connected to said base plate and movable between a raised open position and a lowered bucket-forming position, and a linear actuator operably connected to said clam shell bucket to affect movement thereof, said linear actuator including a base housing and an extendable piston; the steps comprising:

positioning a selector link connected to said base plate in a first mode of operation engaged with said linear actuator;

extending said linear actuator to operate said loader bucket to load material therein;

retracting said linear actuator to affect a raising of said clam shell bucket having material loaded therein;

re-positioning said selector link in a second mode of operation engaged with said linear actuator to secure said base plate to said linear actuator;

re-extending said linear actuator to cause a pivoting of said bucket shell relative to said base plate into said raised open position to affect a dumping of said material from said clam shell bucket;

retracting a second time said linear actuator to affect a pivoting of said bucket shell to said lowered bucket-forming position; and replacing said selector link into said first mode of operation to release said base plate from said linear actuator so that a subsequent extension of said linear actuator will cause a vertical movement of said loader bucket.

17. The method of claim 16 wherein said positioning step and said replacing step include engaging said selector link with said piston.

18. The method of claim 17 wherein said re-positioning step includes engaging said selector link with said base housing of said linear actuator.

19. The method of claim 18 further comprising the step of locking said bucket shell in said raised open position extending step so that said step of retracting a second time said linear actuator cannot affect a pivoting of said bucket shell into said lowered bucket-forming position, said step of retracting a second time said linear actuator allowing said replacing step so that said loader bucket can be operated as a push blade with said bucket shell in said raised open position.

20. The method of claim 18 wherein said positioning step, said re-positioning step and said replacing step include the step of manually pivoting said selector link into engagement with said linear actuator.

* * * * *